United States Patent [19]

DuBois, Jr.

[11] 4,410,830

[45] Oct. 18, 1983

[54] VACUUM FLUORESCENT DISPLAY DEVICE WITH SUBSTRATE INCLUDING A METAL PLATE

[75] Inventor: Richard DuBois, Jr., No. Caldwell, N.J.

[73] Assignee: Edison International Inc., Rolling Meadows, Ill.

[21] Appl. No.: 239,204

[22] Filed: Mar. 3, 1981

[51] Int. Cl.[3] ..... H01J 63/02; H01J 63/06

[52] U.S. Cl. ..... 313/497; 313/513

[58] Field of Search ..... 313/496, 497, 517, 519, 313/513

[56] References Cited

U.S. PATENT DOCUMENTS

| | | | |
|---|---|---|---|
| 3,673,451 | 6/1972 | Tackett | 313/517 |
| 3,723,789 | 3/1973 | Tanji | 313/497 |
| 3,840,770 | 10/1974 | Rogers | 313/517 |
| 4,023,876 | 5/1977 | Fukunaga et al. | 313/497 X |

*Primary Examiner*—Palmer C. Demeo

*Attorney, Agent, or Firm*—Jon C. Gealow; Thomas G. Anderson; Hugh M. Gilroy

[57] ABSTRACT

The invention relates to vacuum fluorescent devices having substrates on which anodes coated with fluorescent material are disposed. According to the invention, the substrate comprises a relatively thin layer of insulation on a metal plate so that the acceleration potential in the vacuum fluorescent device may be increased for greater brightness.

12 Claims, 6 Drawing Figures

VACUUM FLUORESCENT DISPLAY DEVICE WITH SUBSTRATE INCLUDING A METAL PLATE

BACKGROUND OF INVENTION

In prior art vacuum fluorescent devices, anodes coated with fluorescent material usually a phosphor are laid down in a desired arrangement on a glass substrate. A filament and control grid are mounted on the substrate and a transparent cover plate usually of glass is used to enclose the anodes, grid, and filament. The cover is hermetically sealed to the substrate. The assembly is then evacuated and sealed in a conventional manner. Electrical connections enable selective application of electrical potential to excite the phosphor on the anode into fluorescence.

The filament is heated to "boil off" electrons. These electrons are accelerated by an electrical potential between the filament and anode. The accelerated electrons strike the phosphor causing it to fluoresce.

SUMMARY OF INVENTION

In order for the fluorescent devices to be utilized in a high-brightness environment, the fluorescence itself must be relatively bright. Increasing the accelerating potential so that the accelerated electrons have greater energy to excite the phosphor will tend to increase the brightness of fluorescence. But, it has been determined that a phosphor's brightness is also an inverse function of its temperature.

Basically, the phosphor temperature is determined by the external ambient temperature of the environment of the display, the power dissipated within the display, and the net heat transfer between the display and the external environment. Increasing the accelerating potential results in increasing heat dissipation within the display. Thus, the phosphor temperature will increase with an increased acceleration potential and tend to reduce phosphor efficiency and expected brightness of the fluorescence. Phosphor efficiency is here defined as brightness per unit of current per unit area of phosphor.

Heretofore, the substrate has been made exclusively of glass. Glass has been the material of choice because of the properties of its rigidity, fusibility, and stability in vacuum tube applications. The vacuum enclosure is subjected to a pressure of about one atmosphere and the substrate glass must be thick enough not to deform under the pressure. If it is not thick enough the glass may deform and excessive stress may be placed on the hermetic seal.

The conductivity of glass is typically in the order of about 0.59 btu/h/ft$^2$/°F./ft. Both the required thickness of the glass substrate and its low thermal conductivity are in direct contradistinction to those criteria for effective heat transfer.

In accordance with the present invention, the substrate of vacuum fluorescent devices comprises a metal plate or sheet having a coating of an insulating material such as glass. The glass coated metal plate provides highly efficient heat transfer to the external environment which tends to lower the temperature of the phosphor and provide increased brightness of fluorescence with an increase in the accelerating potential.

The metal plate or sheet is selected to have strength comparable to that of conventional glass substrates and for best results the metal plate or sheet is selected to have a thermal conductivity in general of about 6 btu/h/ft.$^2$/°F./ft. and approximately the same coefficient of expansion as the cover plate of the device.

The coating of insulating material on the metal substrate may by any conventional insulating material heretofore used in vacuum fluorescent devices and glass is the preferred material. Best results are achieved with a relatively thin coating of glass of about 0.0005 to 0.010 inch which is bonded to the metal substrate in known manner.

In a preferred embodiment of the invention, the metal substrate is extended to project out beyond the cover of the device so that it can be punched or formed into various configurations to provide mounting points, connector supports and any other desired forms for the application at hand.

In another embodiment, a plurality of spaced holes are disposed in the substrate at preselected locations chosen for convenience or, for example, to correspond to the positions of the various electrical elements to be mounted on the substrate. The sides of each hole are coated by a continuation of the insulating coating of the metal sheet. Conducting pins may extend through these holes for connection to external power or signal sources.

Preferably, however, the holes are filled with a conductive composition such as one of the known thick film conductors. The substrate is then heated to fuse the composition to provide hermetically sealed electrical conductors feeding through the insulated substrate.

Figure 1:
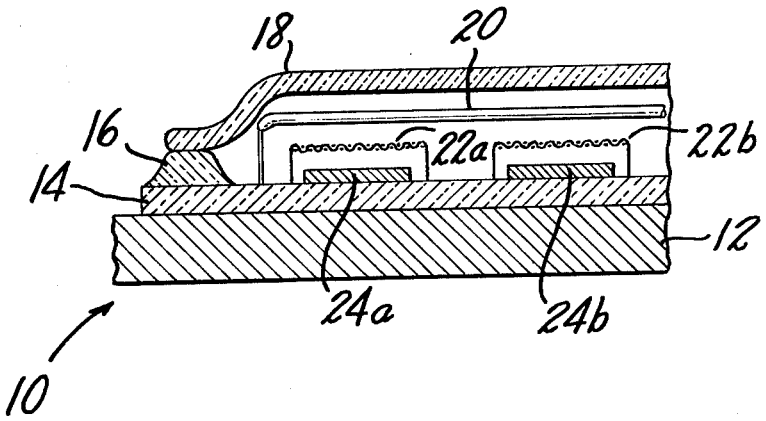
FIG. 1 is a section of portion of a vacuum fluorescent device incorporating the invention.

Referring now to FIG. 1, a cutoff portion of a vacuum fluorescent device is shown generally at 10. A steel metal plate 12 of at least sufficient thickness to minimize deformation acts as a support for the device 10. A layer of glass 14 about 0.001 inch thick is laid down on the metal plate. Anodes 24*a*, 24*b*, etc. coated in conventional manner with a fluorescent material are arranged on the glass layer in the desired configuration. A filament 20 and control grids 22 are mounted on the substrate over the anodes. A glass cover 18 encloses the anodes 24*a*, 24*b*, etc., control grids 22*a*, 22*b*, etc. and the filament 20. The cover plate is hermetically sealed to the substrate by use of a frit material 16.

Figure 2:
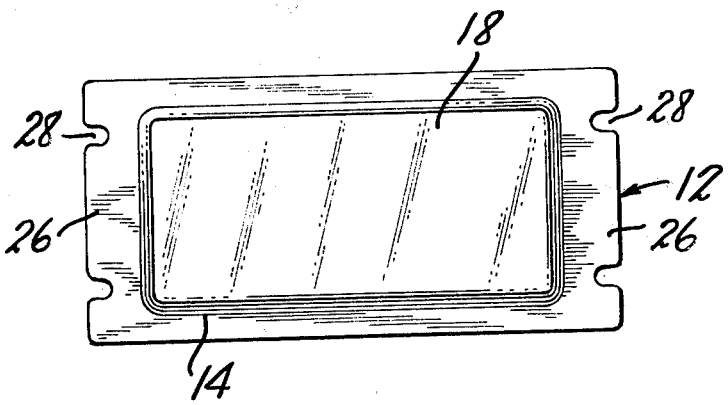
FIG. 2 is a top view of the vacuum fluorescent device showing an extension of the substrate according to the invention.

In the embodiment shown in FIG. 2, the metal substrate used in FIG. 1 is extended to project out beyond the cover 18 and the extensions 26 at opposite ends thereof are provided with slots 28 for positioning over prethreaded holes (not shown) in order for the device to be secured by screws (also not shown).

The anodes, grids and filament(s) may be electrically connected to appropriate power and signal sources through conventional leads which pass through the frit (not shown), see for example U.S. Pat. No. 4,132,920 incorporated herein by reference.

For best results, the metal plate 12, the glass coating 14 and the glass cover plate 18 are each manufactured from material having similar or at least compatible coefficients of expansion so that strains will not develop between the seals, the substrate and cover plate.

The glass layer 14 adhering to the metal plate 12 provides electrical insulation between the metal plate 12 and the anodes 24*a*, 24*b*. Preferably, the glass layer 14 is approximately 0.0005 to 0.010 inch thick. This range of thickness provides sufficient electrical insulation as well as the required foundation for sealing the cover plate 18 to the substrate. If desired, the periphery of the glass coating may be discontinued adjacent to the inside edges of the cover, and the cover in such case may be bonded directly to the metal of the substrate to form the hermetic seal. Most important, the relative thinness of the glass layer 14 which is in close contact with the metal plate having high thermal conductivity (typically on the order of 6 btu/h/ft. $^2$F/°F./ft.) allows efficient heat transfer from the interior of the device to the external environment.

The substrate of the present invention is capable of discharging to the external environment a much larger portion of the heat built up in the device than any of the substrates previously known. The result is a cooler phosphor temperature and therefore increased efficiency.

An additional benefit is that the metal substrate may extend beyond the limits of the window and can be formed or punched into various shapes which can be utilized for mounting points, etc. This was impossible with the previous glass structures because of the inability to cold form glass.

Figure 3:
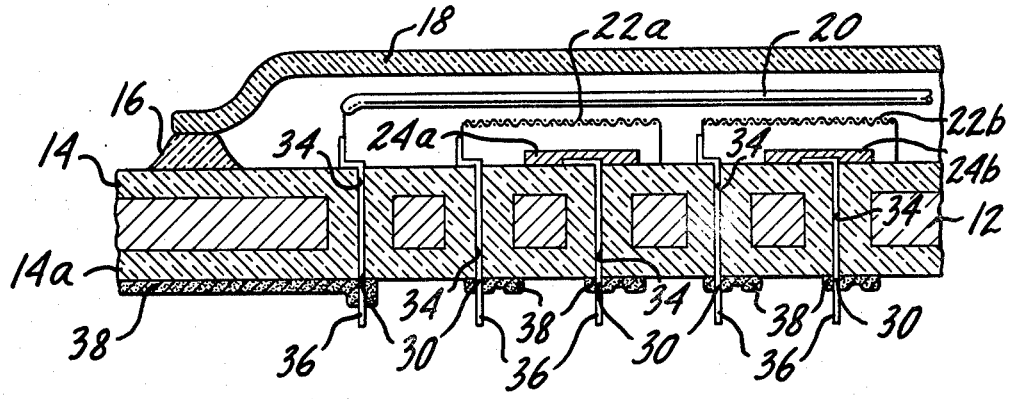
FIG. 3 is a section of a portion of a vacuum fluorescent device according to the invention having electrically conducting pins projecting through the insulated substrate.

As shown in FIG. 3, the anodes, grids and filament may alternatively be electrically connected to external signal and power sources by use of conducting pins which extend through holes in the insulated substrate according to the invention.

The device of FIG. 3 is substantially that of FIG. 1, therefore the same numbers are used to refer to the similar elements in each figure. Only the differences between the two embodiments will be discussed in the following paragraph.

As seen in FIG. 3, holes 30 are provided in the metal plate 12 whereafter the insulating glass layer is applied thereto, covering both the top and bottom of the metal plate 12 in this embodiment with insulating layer 14 and 14*a*, respectively. The glass layer coats the inside edges 34 of the holes 30 so that the metal plate 12 is electrically isolated from each of the pins 36 carried through the holes for external connection of the anodes 24*a*, 24*b*, grids 22*a*, 22*b* and filament 20 illustrated to signal and power sources (not shown). The pins 36 can be connected to a desired source through a series of electrically conducting paths 38 laid down on the outside of the bottom glass insulating layer 14*a*.

Figure 4:
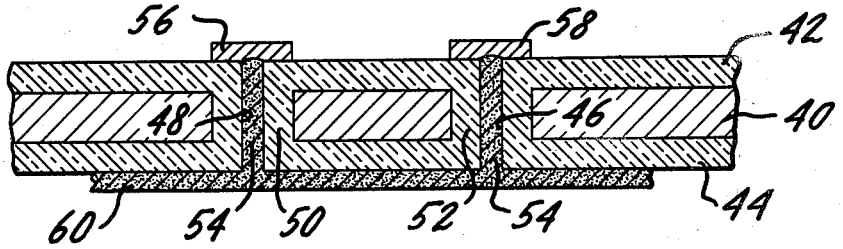
FIG. 4 is a section of a portion of a substrate according to the invention showing insulated holes filled with conductive composition.

FIG. 4 shows a section of a portion of an insulated substrate according to the invention. A metal sheet 40, preferably configured as in FIG. 2, has an upper insulating coating 42, preferably of glass, and a lower coating 44 of similar material. Two representative holes 46 and 48 are shown penetrating the metal sheet. It will be appreciated that a fewer or greater number of holes may be included in the substrate as desired. The sides of the holes 46 and 48 are lined by coatings 50 and 52, respectively, which are continuous with the coatings 42 and 44.

As illustrated, each of the lined holes 46 and 48 are filled with a fused conductive composition 54. Conductive compositions are well known in thick film conductor practice and may, for example, comprise silver in proportions of between approximately 30% to approximately 70%, particles of glass, and a solvent or vehicle for suspending the mixture of glass and silver particles. Other conductive compositions which may be utilized include those in which the conductor comprises palladium-silver, gold, palladium-gold, nickel, copper, or nickel-copper compositions. The material is originally a paste-like substance. In this form it is either injected into the holes 46 and 48, or, alternatively, sucked into the holes by use of a conventional vacuum process.

The paste-like conductive composition material must be dried and fired in order to fuse the glass particles so as to provide a strong mechanical bond. The processes for firing these compositions are well known and will not be further described.

The fusing of the composition material 54 provides both a hermetic seal in the holes 46 and 48 through the substrate and a conducting path leading from the exterior to the interior of the device.

Conventional anodes 56 and 58 are laid down in a known manner over the filled holes 46 and 48. As illustrated here also a conductor 60 of similar or different composition material is laid down to electrically connect both anodes 56 and 58. The conductor 60 may be laid down in any convenient location for providing electrical connection to any desired power or signal source (not shown).

A single firing process may be carried out so that anodes 56 and 58, the composition 54 filling holes 46 and 48, and conducting path 60 are each fused simultaneously or, of course, each of these elements may be fired at a separate stage in the manufacture of the substrate. It will be appreciated that any suitable combination of these elements could be fused simultaneously.

It will be appreciated that conductors may also be laid down on the top of the glass coating 42 in a similar manner as that illustrated by conductor 60.

Figure 5:
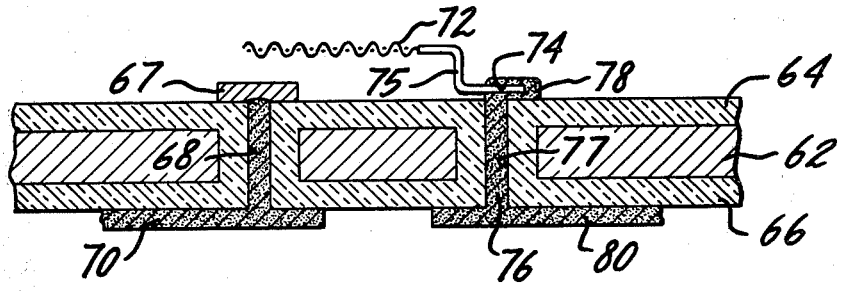
FIG. 5 is a section of a portion of a substrate according to the invention showing a grid mounted thereon by use of the conductive composition.

FIG. 5 shows a substrate according to the invention wherein a portion of a metal sheet 62, again preferably configured as shown in FIG. 2, coatings 64 and 66, anode 67, filled hole 68 and conductor 70 are each as described in FIG. 4.

A grid element 72, preferably having a hole 74 at the mounting end 75 thereof, is mechanically bonded and electrically connected to the fused conductive composition 76 in hole 74. For bonding, the grid 72 is mechanically held in position on the substrate while a bead 78 of conductive composition is placed over the end 75 as illustrated and then dried. The dried composition bead 78 is then fired to fuse the bead 78 according to the known process to bond the end 75 of the grid 72 to the substrate according to the invention and to the fused composition material 76. As illustrated, a representative conductor leads from the filled hole 70 and may be carried to any desired point on the substrate for connection to a power or signal source (not shown).

Figure 6:
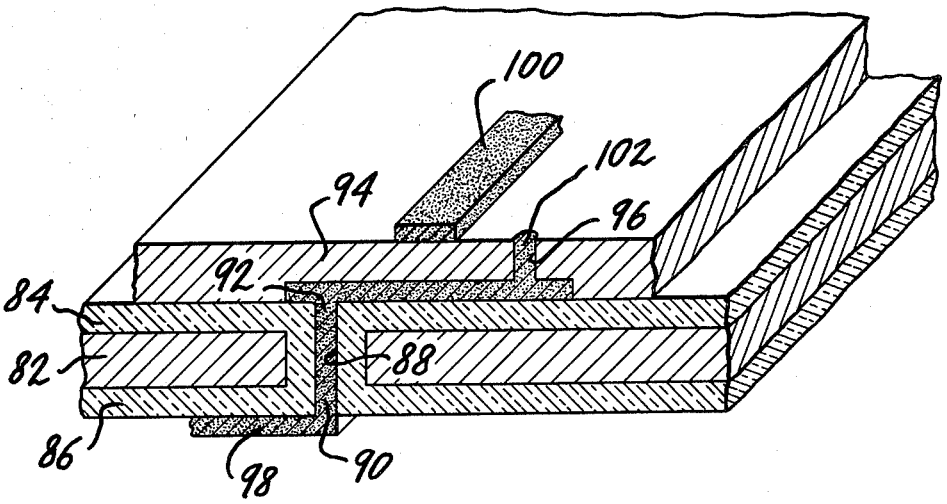
FIG. 6 illustrates in section another embodiment according to the invention having cross-over connections and multiple substrates.

FIG. 6 is a portion of a substrate according to the invention partially in section in which connector crossovers and a multi-layer substrate according to the invention are shown. Metal sheet 82 is shown with one hole 88 therein. Metal sheet 82 is coated with an upper coat 84 and a lower coat 86 of glass as described previously. Hole 88 is filled with conductive composition 90 as has been previously described.

A conductor 92 is laid down on the upper coating 84 in a manner as previously described for the lower surface in FIGS. 4 and 5. A layer of glass 94, having a hole 96 in register with a point on the conductor 92 is laid down in conventional manner over the conductor 92 and the coating 84. Other conducting paths 98 and 100 may then be added in conjunction with the injection of composition material 102 in the hole 96. The conventional processes for firing of each of the glass layers, conductors and conductive composition filled holes may be carried out either sequentially or in suitable simultaneous steps.

It will be understood that the claims are intended to cover all changes and modifications of the preferred embodiments of the invention herein chosen for the purposes of illustration which do not constitute departures from the spirit and the scope of the invention.

What is claimed is:

1. A vacuum fluorescent device comprising:
(a) a metal plate;
(b) a coating of insulation on said metal plate, said insulating coating and metal plate forming an insulated substrate;
(c) at least one anode coated with fluorescent material disposed on said coating of said insulated substrate;
(d) a transparent cover hermetically sealed to said substrate, said cover and substrate forming an enclosure for said at least one anode, said metal plate extending outwardly beyond the periphery of said cover wherein the metal plate extending outwardly beyond the cover has no insulating coating whereby the metal plate outside said cover may be cold formed; and
(e) means in said vacuum fluroescent device for selectively exciting said at least one anode.

2. In a vacuum fluorescent device of the type having a substrate, at least one fluorescent anode on said substrate, a transparent cover hermetically sealed to said substrate and enclosing said anode, the improvement wherein said substrate comprises a metal plate having an insulating coating thereon, and said metal plate has at least one hole extending therethrough, said insulating coating covers an upper surface and a lower surface of said metal plate and the sides of said at least one hole, said hole being filled with a fused conductive composition for hermetically sealing said at least one hole and for providing and electrically conducting path between said upper and lower surfaces.

3. The device of claim 2 wherein said at least one fluorescent anode is positioned on said substrate above an upper end of said at least one hole.

4. The device of claim 3 wherein there are a plurality of spaced holes, each hole being filled with said fused conductive composition, and there are a plurality of anodes, each anode of said plurality of anodes being laid down, on said substrate above an upper end of at least some of said plurality of spaced holes, respectively, and further comprising means for electrical connection to a lower end of the fused composition of each said hole, said means for electrical connection being affixed on said lower surface of said substrate.

5. The device of claim 2 wherein the metal plate has a glass insulating coating and wherein the glass coating and the cover have substantially similar coefficients of expansion.

6. The device of claim 5 wherein the range of thickness of said glass coating is approximately 0.0005 inch to 0.010 inch.

7. A vacuum fluorescent device comprising:
(a) a metal plate;
(b) a glass coating on said metal plate;
(c) said metal plate having said glass coating thereon forming an insulated metal substrate;
(d) a plurality of anodes disposed on said glass coating;
(e) a fluorescent coating on each of said plurality of anodes;
(f) a plurality of grids mounted on said substrate;
(g) each of said grids being operative to selectively control the emission of light from said fluorescent coatings on said anodes;
(h) at least one filament mounted on said substrate, said filament being adapted to supply electrons to said anodes when said filament is heated;
(i) a transparent cover hermetically sealed to said insulated metal substrate, said transparent cover and insulated substrate forming thereby a hermetically sealed enclosure for said plurality of anodes, said plurality of grids, and said at least one filament; and
(j) means for connecting said plurality of anodes, said plurality of grids, and said filament to external sources of signals and power including,
(i) said insulated metal substrate having a plurality of holes;
(ii) a conducting pin in each of said plurality of holes;
(iii) said glass coating hermetically sealing each of said plurality of holes and electrically insulating said conducting pin from said metal sheet; and
(iv) each of said plurality of pins being electrically connected to at least one of said plurality of anodes, said plurality of grids, and said at least one filament.

8. The device of claim 7 further comprising further glass coating on the side of said metal sheet opposite said transparent cover and a plurality of electrically conducting paths on said further glass coating for connecting said electrically conducting pins to said external sources.

9. A vacuum fluorescent device comprising:
(a) a metal plate;
(b) a glass coating on said metal plate;
(c) said metal plate having said glass coating thereon forming an insulated metal substrate;
(d) a plurality of anodes disposed on said glass coating;
(e) a fluorescent coating on each of said plurality of anodes;
(f) a plurality of grids mounted on said substrate;
(g) each of said grids being operative to selectively control the emission of light from said fluroescent coatings on said anodes;
(h) at least one filament mounted on said substrate, said filament being adapted to supply electrons to said anodes when said filament is heated;
(i) a transparent cover hermetically sealed to said insulated metal substrate, said transparent cover and insulated substrate forming thereby a hermetically sealed enclosure for said plurality of anodes, said plurality of grids, and said at least one filament; and (j) means for connecting said plurality of anodes, said plurality of grids, and said filament to external sources of signals and power including,
  (i) said insulated metal substrate having a plurality of holes;
  (ii) a fused conductive composition in each of said plurality of holes;
  (iii) said glass coating hermetically sealing each of said plurality of holes and electrically insulating said fused conductive composition from said metal sheet; and
  (iv) said fused conductive composition in each of said plurality of holes being electrically connected to at least one of said plurality of anodes, said plurality of grids, and said at least one filament.

10. The vacuum fluorescent device of claim 9 wherein said plurality of anodes is laid down directly on the fused composition in at least some of said plurality of holes.

11. The vacuum fluorescent device of claim 9 wherein each said grid is mounted on said substrate by a fused bead of conductive composition.

12. The vacuum fluorescent device of claim 9 further comprising at least one additional glass coating having a conducting path laid down thereon, and said conducting path being in electrical connection with another conducting path on said glass coating on said metal plate through a fused conductive composition conductor in a hole in said additional glass coating.

* * * * *